United States Patent [19]

Specktor

[11] 4,263,802

[45] Apr. 28, 1981

[54] LOCKING APPARATUS

[76] Inventor: Gerald A. Specktor, 409 Cleveland Ave. S., St. Paul, Minn. 55105

[21] Appl. No.: 19,681

[22] Filed: Mar. 12, 1979

Related U.S. Application Data

[62] Division of Ser. No. 496,848, Aug. 12, 1974, Pat. No. 4,151,737.

[51] Int. Cl.[3] ..... B21D 1/12

[52] U.S. Cl. ..... 72/457; 72/705

[58] Field of Search ..... 72/705, 446, 447, 457

[56] References Cited

U.S. PATENT DOCUMENTS

| | | | |
|---|---|---|---|
| 3,626,747 | 12/1971 | Rouis | 72/705 |
| 3,776,021 | 12/1973 | Lionello | 72/705 |
| 3,888,100 | 6/1975 | Chisum | 72/705 |
| 3,927,550 | 12/1975 | Samuelsson | 72/705 |

FOREIGN PATENT DOCUMENTS

| | | | |
|---|---|---|---|
| 944671 | 4/1974 | Canada | 72/705 |
| 1323163 | 7/1973 | United Kingdom | 72/705 |

*Primary Examiner*—Lowell A. Larson

*Attorney, Agent, or Firm*—Wicks & Nemer

[57] ABSTRACT

Locking apparatus is disclosed in its preferred form for use in an apparatus for repairing and straightening the body and frame of a vehicle having force applying members pivotally interconnected to a tread member by connector arms. Regular shaped apertures extend vertically through the tread member. The preferred apparatus of the present invention includes an upraised channel formed on the connector arm of the force applying member and a locking pin including a body portion having a cross section of a regular shape corresponding to the apertures formed in the tread member, an inverted U-shaped handle extending beyond the circumference of the body portion to prevent the body portion from falling through the apertures of the tread member, and a square portion located on the bottommost portion of the body portion. The square portion has a diagonal which is less than or equal to the diameter of the body portion such that the locking pin can be inserted into and passed through the apertures of the tread member to position the square portion within the U-shaped inside surface or to abut with the outside surfaces of the channel member.

9 Claims, 3 Drawing Figures

LOCKING APPARATUS

CROSS REFERENCE

This is a division of application Ser. No. 496,848 filed Aug. 12, 1974, by the same inventor, now U.S. Pat. No. 4,151,737 issued May 1, 1979.

BACKGROUND

This invention relates generally to locking apparatus and more particularly, in the referred embodiment, to locking apparatus for use in an apparatus for repairing and straightening vehicle bodies and frames.

In the field of locking apparatus for use in an apparatus for repairing and straightening, various types of apparatus are currently available but present serious limitations and deficiencies regarding the ability of repair personnel to position force applying members at any desired angle. For example, in some apparatus, the force applying members are locked by use of a bolt which is threadably attached to a nut in the connector arm of the force applying members. Therefore, it is necessary to exactly align the force applying member corresponding to the location of the nut in the connector arm rather than by the position desired of the force applying member to the vehicle. Other apparatus includes pins which extend into holes formed in the connector arm and suffer from a like deficiency. Further, known apparatus allow the force applying members to pivot through a small angle thereby preventing the operator from positioning the force applying members in the exact position desired.

Therefore, there is a definite need in the art for a locking apparatus for use in an apparatus for repairing and straightening which allows for rapid and secure positioning of the force applying members at any desired angle.

SUMMARY

The present invention solves these and other problems in locking apparatus for use in an apparatus for repairing and straightening including at least one force applying member pivotally interconnected to the repairing and straightening apparatus by a connector arm and regular shaped apertures which extend vertically through the repairing and straightening apparatus. Specifically these and other problems are solved by providing, in the preferred embodiment, a locking apparatus including an upraised channel formed on the connector arm of the force applying member and a locking pin including a body portion having a cross section of a regular shape corresponding to the apertures formed in the repairing and straightening apparatus, a member for preventing the body portion from falling through the apertures of the repairing and straightening apparatus, and a member for abutting the channel of the connector arm of the force applying member.

In the preferred embodiment, the channel formed on the connector arm includes a U-shaped inside surface and outside surfaces located on the opposite side of the U-shaped inside surfaces such that the abutting member can be positioned within the U-shaped inside surface or can abut with the outside surfaces for positional variation.

Therefore, it is a primary object of this invention to provide novel locking apparatus.

It is also an object of this invention to provide novel locking apparatus for use in an apparatus for repairing and straightening vehicle frames and bodies.

It is also an object of this invention to provide novel locking apparatus allowing easy and quick locking of the force applying members at any desired angle about the vehicle.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figures 1, 4, 7:
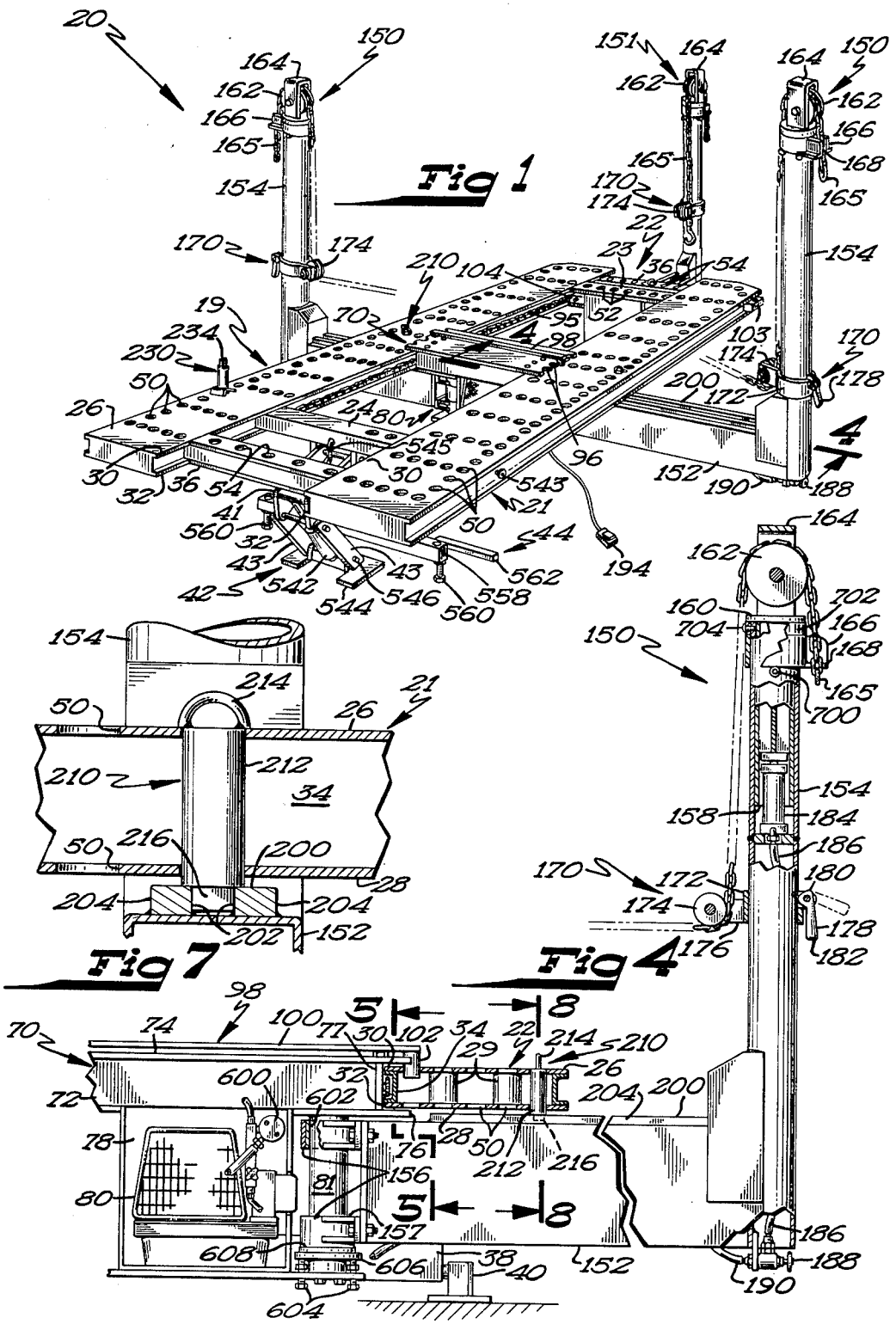
FIG. 1 is a perspective view of an apparatus for repairing and straightening the body and frame of a vehicle using the locking apparatus according to the teachings of the present invention.
FIG. 4 is partial sectional view taken along section line 4—4 in FIG. 1.
FIG. 7 is a partial sectional view taken along section line 7—7 in FIG. 3.

The remaining figures of the drawings of the present invention and the remaining disclosure of the present invention, including preferred embodiments, are incorporated herein by reference to application Ser. No. 496,848 filed Aug. 12, 1974, by Gerald A. Specktor, entitled "Apparatus for Repairing and Straightening", now U.S Pat. No. 4,151,737, the parent application of the present application.

What is claim is:

1. Locking apparatus for use in an apparatus for repairing and straightening having a least one force applying member pivotally interconnected to the repairing and straightening apparatus by a connector arm, and regular shaped apertures which extend vertically through the repairing and straightening apparatus, comprising, in combination: an upraised channel formed on the connector arm of the force applying member; and a locking pin including: a body portion having a cross section of a regular shape corresponding to the apertures formed in the repairing and straightening apparatus; first means for preventing the body portion falling through the apertures of the repairing and straightening apparatus; and second means for abutting with the channel on the connector arm of the force applying member comprising a square portion located on the bottommost end of the body portion, with the square portion having a diagonal which is less than or equal to the diameter of the body portion such that the square portion does not extend beyond the circumference of the body portion allowing the square portion and the body portion of the locking pin to be inserted into and passed through the apertures such that the square portion can be positioned to abut with the channel formed on the connector arm of the force applying member.

2. Locking apparatus for use in an apparatus for repairing and straightening having at least one force applying member pivotally interconnected to the repairing and straightening apparatus by a connector arm, and regular shaped apertures which extend vertically through the repairing and straightening apparatus, comprising, in combination: an upraised channel formed on the connector arm of the force applying member comprising, in combination: a U-shaped inside surface and outside surfaces located on opposite sides of the U-shaped inside surface; and a locking pin including: a body portion having a cross section of a regular shape corresponding to the apertures formed in the repairing and straightening apparatus; first means for preventing the body portion from falling through the apertures of the repairing and straightening apparatus; and second means for abutting with the channel on the connector arm of the force applying member such that the second means can abut with and can be captured within the U-shaped inside surface or alternately the second means can abut with either of the outside surfaces.

3. The apparatus of claim 2 wherein the second means comprises a square portion located on the bottommost end of the body portion, with the square portion having a diagonal which is less than or equal to the diameter of the body portion such that the square portion does not extend beyond the circumference of the body portion allowing the square portion and the body portion of the locking pin to be inserted into and passed through the apertures such that the square portion can be positioned within the U-shaped inside surface or alternately to abut with the outside surfaces of the channel formed on the connector arm of the force applying member.

4. The apparatus of claim 1 or 3 wherein the first means comprises an inverted U-shaped handle which extends beyond the circumference of the body portion also for grasping by the operator to remove the body portion from the apertures.

5. The apparatus of claim 1 or 3 wherein the cross section of the body portion is circular.

6. The apparatus of claim 1 or 3 wherein the repairing and straightening apparatus includes a tread member for use in supporting a vehicle thereon having a top surface and a bottom surface, with the apertures extending through the top surface and bottom surface of the tread member in a substantially vertically aligned manner.

7. The apparatus of claim 6 wherein the force applying member is pivotally interconnected to the tread member.

8. The apparatus of claim 1 or 3 wherein the force applying member is pivotally mounted on a stationary pivot member.

9. The apparatus of claim 1 or 3 wherein the repairing and straightening apparatus further includes a tram movably mounted to the apparatus for repairing and straightening, with the tram including at least one pivot member, and with the force applying member pivotally mounted to the pivot member of the tram.

* * * * *